US011702315B2

(12) United States Patent
Beaubois

(10) Patent No.: US 11,702,315 B2
(45) Date of Patent: Jul. 18, 2023

(54) EMERGENCY MONITORING SYSTEMS FOR ELEVATORS

(71) Applicant: Otis Elevator Company, Farmington, CT (US)

(72) Inventor: Nicolas Beaubois, Chatillon sur Loire (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 1237 days.

(21) Appl. No.: 16/181,532

(22) Filed: Nov. 6, 2018

(65) Prior Publication Data

US 2019/0135581 A1 May 9, 2019

(30) Foreign Application Priority Data

Nov. 8, 2017 (EP) ..... 17306540

(51) Int. Cl.

| | |
|---|---|
| ***B66B 3/00*** | (2006.01) |
| ***B66B 1/34*** | (2006.01) |
| ***B66B 5/00*** | (2006.01) |
| ***B66B 5/02*** | (2006.01) |

(52) U.S. Cl.

CPC ..... *B66B 3/002* (2013.01); *B66B 1/3407* (2013.01); *B66B 3/00* (2013.01); *B66B 5/0018* (2013.01); *B66B 5/024* (2013.01)

(58) Field of Classification Search

CPC ... B66B 5/0025; B66B 5/0031; B66B 5/0018; B66B 5/0012; B66B 3/002; B66B 5/0006; B66B 3/008; B66B 25/006; B66B 1/3492; B66B 2201/4669; B66B 29/005; B66B 3/00

See application file for complete search history.

(56) References Cited

U.S. PATENT DOCUMENTS

| | | | |
|---|---|---|---|
| 5,289,275 | A | 2/1994 | Ishii et al. |
| 5,937,077 | A | 8/1999 | Chan et al. |
| 6,050,369 | A | 4/2000 | Leone et al. |

(Continued)

FOREIGN PATENT DOCUMENTS

| | | | |
|---|---|---|---|
| CN | 101484815 | A | 7/2009 |
| CN | 202321836 | U | 7/2012 |

(Continued)

OTHER PUBLICATIONS

Bialy, Louis et al. "Potential Role of Elevators During Emergencies", Elevator World, Jul. 1, 2004 (13 pages).

(Continued)

*Primary Examiner* — Marlon T Fletcher
(74) *Attorney, Agent, or Firm* — Cantor Colburn LLP

(57) ABSTRACT

Elevator systems and methods for displaying information associated with the elevator systems. The systems including an elevator car located within an elevator shaft, a display located within the elevator car, and an elevator emergency monitoring system having an elevator shaft monitoring device mounted on the elevator car and configured to capture an image of the elevator shaft. The elevator car is operable in an emergency mode of operation such that an image captured by the elevator shaft monitoring device is displayed on the display within the elevator car.

15 Claims, 5 Drawing Sheets

(56) References Cited

U.S. PATENT DOCUMENTS

| | | | | |
|---|---|---|---|---|
| 6,161,654 | A * | 12/2000 | Sirigu | B66B 3/008 187/391 |
| 6,615,175 | B1 | 9/2003 | Gazdzinski | |
| 6,628,323 | B1 | 9/2003 | Wegmann | |
| 6,956,485 | B1 | 10/2005 | Aird et al. | |
| 7,448,473 | B2 | 11/2008 | Lindberg et al. | |
| 7,495,573 | B2 | 2/2009 | Tice et al. | |
| 3,020,672 | A1 | 9/2011 | Lin et al. | |
| 9,571,798 | B2 | 2/2017 | Gorilovskij et al. | |
| 2007/0261924 | A1* | 11/2007 | Lindberg | B66B 1/3423 187/391 |
| 2009/0057069 | A1 | 3/2009 | Boggess | |
| 2014/0182974 | A1* | 7/2014 | Puranen | B66B 7/062 187/247 |
| 2015/0170486 | A1 | 6/2015 | Penland | |
| 2017/0073187 | A1 | 3/2017 | Youker et al. | |
| 2018/0105397 | A1* | 4/2018 | Odye | B66B 5/0012 |
| 2019/0135581 | A1* | 5/2019 | Beaubois | B66B 5/0018 |
| 2019/0389689 | A1* | 12/2019 | Jia | B66B 1/3476 |
| 2020/0024103 | A1* | 1/2020 | Amuduri | B66B 3/00 |
| 2020/0031619 | A1* | 1/2020 | Sudi | B66B 13/26 |
| 2020/0031627 | A1* | 1/2020 | Bezault | B66B 13/22 |
| 2021/0245995 | A1* | 8/2021 | Copeland | B66B 5/0025 |

FOREIGN PATENT DOCUMENTS

| | | | | |
|---|---|---|---|---|
| CN | 209967503 | U * | 1/2020 | A62C 99/0081 |
| EP | 1809560 | B1 | 4/2012 | |
| EP | 2610202 | A1 | 7/2013 | |
| EP | 3406556 | A1 * | 11/2018 | B66B 11/0226 |
| JP | H11349242 | A * | 12/1999 | |
| JP | 2008290842 | A * | 12/2008 | |
| JP | 2008290842 | A | 12/2008 | |
| JP | 2011063423 | A | 3/2011 | |
| JP | 2015151207 | A | 8/2015 | |
| JP | 2017100839 | A * | 6/2017 | B66B 1/18 |
| JP | 2021147225 | A * | 9/2021 | |
| WO | 2008107952 | A1 | 9/2008 | |
| WO | 2012026016 | A1 | 3/2012 | |
| WO | WO-2021209673 | A1 * | 10/2021 | B66B 1/468 |

OTHER PUBLICATIONS

European Search Report, European Application No. 17306540.0, dated May 4, 2018, European Patent Office; European Search Report 11 pages.

* cited by examiner

EMERGENCY MONITORING SYSTEMS FOR ELEVATORS

CROSS REFERENCE TO RELATED APPLICATIONS

This application claims the benefit of European Application No. 17306540.0, filed Nov. 8, 2017, which is incorporated herein by reference in its entirety.

BACKGROUND

The subject matter disclosed herein generally relates to elevator cars and, more particularly, elevator systems and methods for monitoring elevator shafts.

During emergency situations within buildings, emergency personnel may be required to travel within an elevator car to reach a floor/landing where an emergency situation/condition is happening. Typically, such travel by emergency personnel is "blind," meaning that the emergency personnel cannot determine the status of conditions within the elevator shaft and/or at a given landing within the building. Accordingly, systems for aiding emergency personnel during emergencies may be beneficial.

SUMMARY

According to some embodiments, elevator systems are provided. The elevator systems include an elevator car located within an elevator shaft, a display located within the elevator car, and elevator emergency monitoring system having an elevator shaft monitoring device mounted on the elevator car and configured to capture an image of the elevator shaft. The elevator car is operable in an emergency mode of operation such that an image captured by the elevator shaft monitoring device is displayed on the display within the elevator car.

In addition to one or more of the features described herein, or as an alternative, further embodiments of the systems may include that, during the emergency mode of operation, a first display image is generated on the display.

In addition to one or more of the features described herein, or as an alternative, further embodiments of the systems may include that the elevator shaft monitoring device is mounted to a top of the elevator car such that a portion of the elevator shaft above the elevator car is captured by the elevator shaft monitoring device.

In addition to one or more of the features described herein, or as an alternative, further embodiments of the systems may include that the elevator emergency monitoring system includes a second elevator shaft monitoring device, wherein the second elevator shaft monitoring device is mounted to the elevator car such that a portion of the elevator shaft below the elevator car is captured by the elevator shaft monitoring device, preferably, wherein a second display image is generated on the display providing an image captured by the second elevator shaft monitoring device.

In addition to one or more of the features described herein, or as an alternative, further embodiments of the systems may include at least one third display image displayed on the display, wherein the at least one third display image is an image of a landing of the elevator system.

In addition to one or more of the features described herein, or as an alternative, further embodiments of the systems may include that the elevator shaft monitoring device comprises at least one of an optical camera and an infrared camera.

According to some embodiments, methods for operating an elevator system are provided. The methods include activating an emergency mode of operation of an elevator car, activating an elevator shaft monitoring device mounted on the elevator car, capturing an image of an elevator shaft using the elevator shaft monitoring device, and displaying the captured image of the elevator shaft on a display within the elevator car.

In addition to one or more of the features described herein, or as an alternative, further embodiments of the method may include that, during the emergency mode of operation, the method comprises displaying a first display image on the display.

In addition to one or more of the features described herein, or as an alternative, further embodiments of the method may include that the elevator shaft monitoring device is mounted to a top of the elevator car such that a portion of the elevator shaft below the elevator car is captured by the elevator shaft monitoring device.

In addition to one or more of the features described herein, or as an alternative, further embodiments of the method may include that the elevator emergency monitoring system includes a second elevator shaft monitoring device, wherein the second elevator shaft monitoring device is mounted to the elevator car such that a portion of the elevator shaft above the elevator car is captured by the elevator shaft monitoring device.

In addition to one or more of the features described herein, or as an alternative, further embodiments of the method may include displaying a second display image on the display providing an image captured by the second elevator shaft monitoring device.

In addition to one or more of the features described herein, or as an alternative, further embodiments of the method may include displaying at least one third display image on the display, wherein the at least one third display image is an image of a landing.

In addition to one or more of the features described herein, or as an alternative, further embodiments of the method may include that the elevator shaft monitoring device comprises at least one of an optical camera and an infrared camera.

In addition to one or more of the features described herein, or as an alternative, further embodiments of the method may include receiving input from a user and displaying a specific set of captured images based on the received input from the user.

In addition to one or more of the features described herein, or as an alternative, further embodiments of the method may include transmitting the captured image to a remote location.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
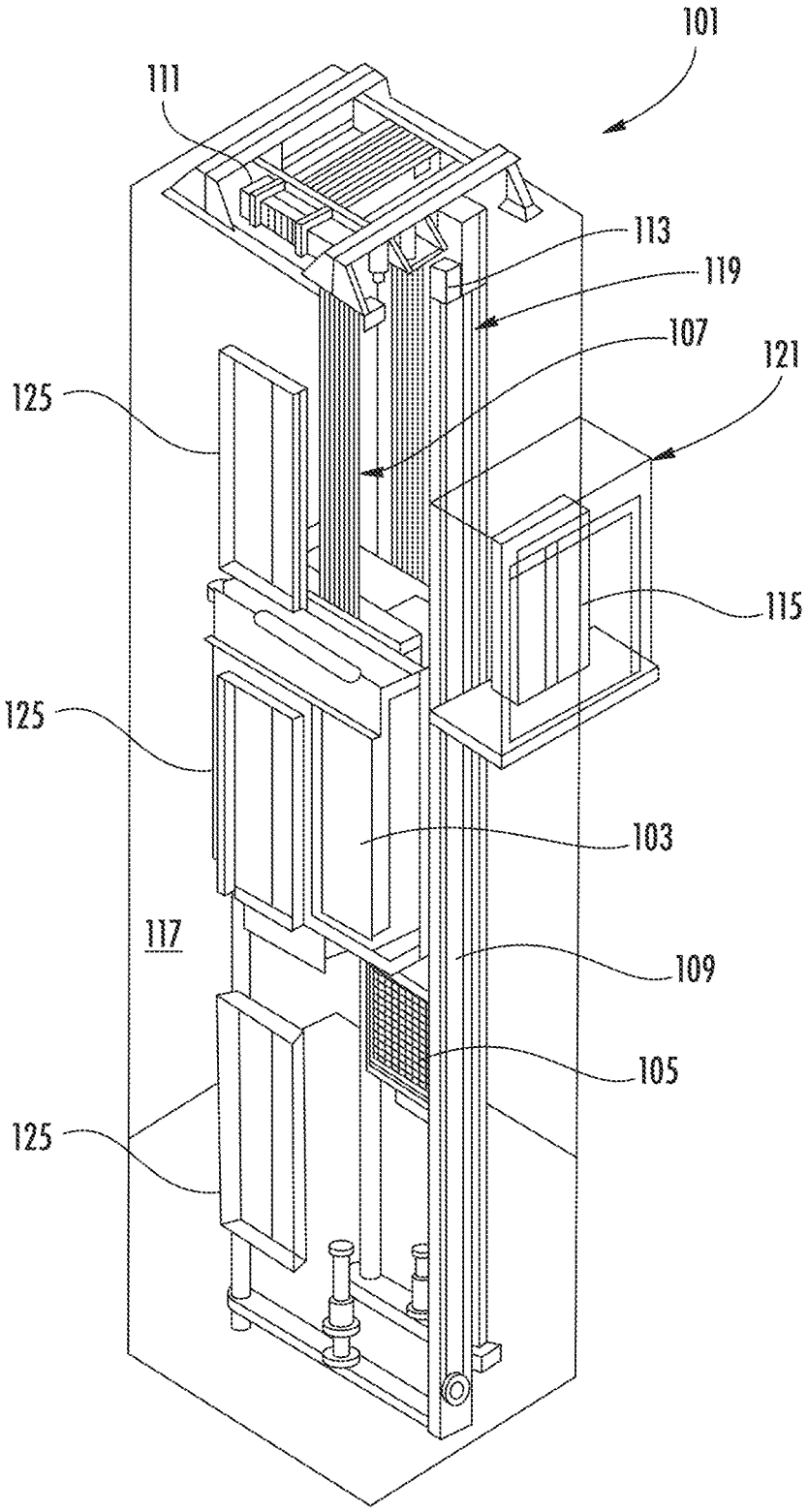
FIG. 1 is a schematic illustration of an elevator system that may employ various embodiments of the present disclosure.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft, such as hydraulic, ropeless, and multi-car systems, may employ embodiments of the present disclosure. FIG. 1 is merely a non-limiting example presented for illustrative and explanatory purposes.

Figure 2:
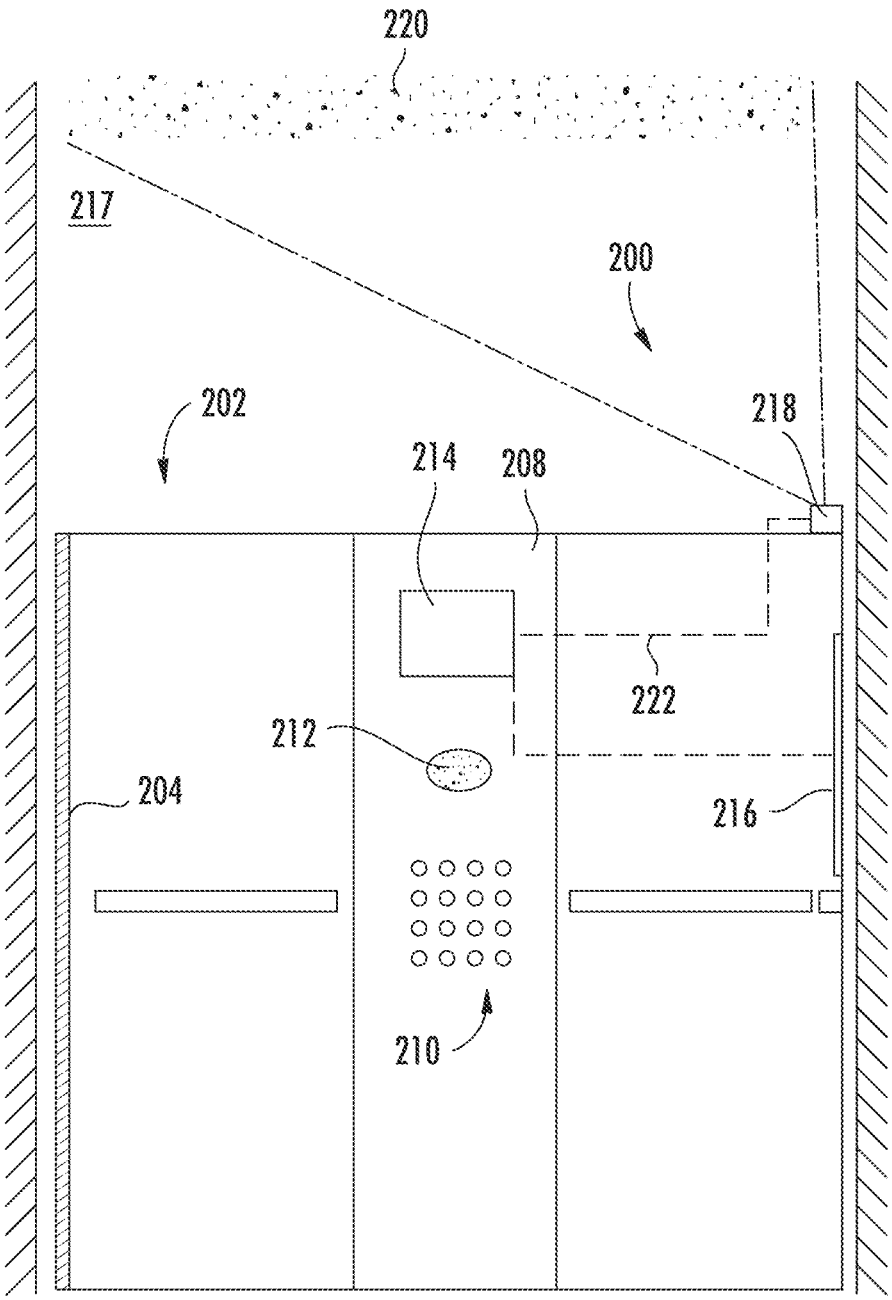
FIG. 2 is a schematic illustration of an elevator car arranged in accordance with an embodiment of the present disclosure.

Turning now to FIG. 2, a schematic illustration of an elevator emergency monitoring system 200 in accordance with a non-limiting embodiment of the present disclosure is shown. The elevator emergency monitoring system 200, as shown, is installed on an elevator car 202. FIG. 2 illustratively shows an interior of the elevator car 202 within a portion of an elevator shaft 217, with various components (e.g., roping system, etc.) not shown for clarity.

The elevator car 202 includes an elevator car door 204 that enables ingress into and egress from the elevator car 202 at one or more landings along the elevator shaft 217, as appreciated by those of skill in the art. The elevator car 202 includes a car operating panel 208 that enables control/operation of the elevator car 202 (e.g., destination floor request, fireman/safety operation, inspection/maintenance operation, etc.). The car operating panel 208 includes a control operating panel 210 (e.g., buttons), a speaker 212, and an operating panel display 214 (e.g., display screen). The control operating panel 210 is configured to enable passengers within the elevator car 202 to select destination floors, open/close elevator car doors, enter access codes, etc. to enable control of the elevator car 202. Further, the control operating panel 210 can enable emergency personnel to control and operate the elevator car 202 during an emergency. The speaker 212 can be used to provide audible notifications to passengers within the elevator car 202 (e.g., notification of the current floor, emergency notifications, etc.). The operating panel display 214 can be used to provide a visual indication or notification to passengers within the elevator car 202, such as current floor, and/or can be used to display other information and/or images, including, but not limited to, weather, commercials, tenant information, etc. In accordance with embodiments of the present disclosure, the operating panel display 214 is also used as part of the elevator emergency monitoring system 200, as described herein.

As shown in FIG. 2, a secondary display 216 can be provided within the elevator car 202 and can provide additional functionality to the elevator emergency monitoring system 200. The secondary display 216 can be mounted to and/or integrated into a wall panel of the elevator car 202 or installed at any other desired location. In some arrangements, the secondary display 216 is a television or other display screen positioned within the elevator car 202 to provide various information and/or entertainment within the elevator car 202 during normal use/operation.

The elevator emergency monitoring system 200 of embodiments of the present disclosure includes an elevator shaft monitoring device 218, such as a camera. The elevator shaft monitoring device 218, as shown, is located on top of the elevator car 202 within the elevator shaft 217 (e.g., on the exterior of the elevator car 202). In some embodiments, an elevator shaft monitoring device can be mounted on the bottom or side of the elevator car, and in some embodiments, multiple elevator shaft monitoring devices can be employed and positioned at multiple locations on the exterior of the elevator car. In one embodiment, the elevator shaft monitoring device 218 can be mounted anywhere as desired on the elevator car 202 provided the elevator shaft monitoring device 218 has a view of the exterior of the elevator car 202 and/or the elevator shaft 217.

The elevator shaft monitoring device 218 is positioned such that it can monitor the elevator shaft 217. For example, the elevator shaft monitoring device 218 can be a camera that is angled upward (from the top of the elevator car 202) to capture a monitored region 220. The monitored region 220 is selected (and the elevator shaft monitoring device 218 angled/positioned) such that the elevator shaft monitoring device 218 can capture images or information regarding parts of the elevator shaft 217, including, but not limited to, landing doors at landings located above the elevator car 202 within the elevator shaft 217 and a view of the elevator shaft 217. In embodiments with an elevator shaft monitoring device mounted on the bottom of the elevator car, the elevator shaft monitoring device can be arranged to capture images/information of parts of the elevator shaft 217, including, but not limited to, landing doors at landings located below the elevator car 202 within the elevator shaft 217 and a view of the elevator shaft 217, The elevator shaft monitoring device 218, as noted, can be a camera or other image capture device that can capture live or real-time images or video or similar information of the elevator shaft 217. In some embodiments, the elevator shaft monitoring device 218 may be an optical camera, visible-spectrum camera, thermal camera, infrared camera, or any other desired imaging and/or image capture device. The elevator shaft monitoring device 218 can include a controller, processor, microprocessor, and/or other components etc. that can enable control and processing as described herein. In some embodiments, a separate control unit can be configured to receive signals, data, and/or information from the elevator shaft monitoring device 218 to perform the functionality as described herein.

As shown, the elevator shaft monitoring device 218 is in communication with the displays 214, 216 over a communication network 222. The communication network 222, although shown as dashed lines and indicating a wired connection, can be configured as a wireless network, or a combination of wired and wireless communication mechanisms. In some embodiments, the communication network 222 can enable the control unit of the elevator emergency monitoring system 200 to operably control one or more of the elevator shaft monitoring device 218 and the displays 214, 216.

In operation, the elevator emergency monitoring system 200 is configured to provide information to an authorized person located within the elevator car 202 regarding the environment of the elevator shaft 217. In operation, an authorized person, such as a fireman, technician, or emergency personnel can operate the elevator car 202 in an emergency mode of operation, as appreciated by those of skill in the art (e.g., use special key, etc.). When the elevator car 202 is operated in the emergency mode of operation, the elevator emergency monitoring system 200 is activated (and the elevator shaft monitoring device 218 thereof) to capture live images or information related to the elevator shaft 217, such as visible, optical, and/or infrared image data. The image data captured by the elevator shaft monitoring device 218 can be communicated or transmitted to a display within the elevator car 202 (e.g., displays 214, 216). The image data can thus be presented to a person within the elevator car 202 to inform the person of conditions within the elevator shaft 217 (or associated with one or more landings of the elevator system).

For example, when the elevator shaft monitoring device 218 is operated, detection of the presence of conditions within the elevator shaft 217 can be made. Such conditions can include, but are not limited to fires, smoke, particulate matter, heat signatures (e.g., heated elevator landing doors due to fires located at a landing), etc.

Figure 3:
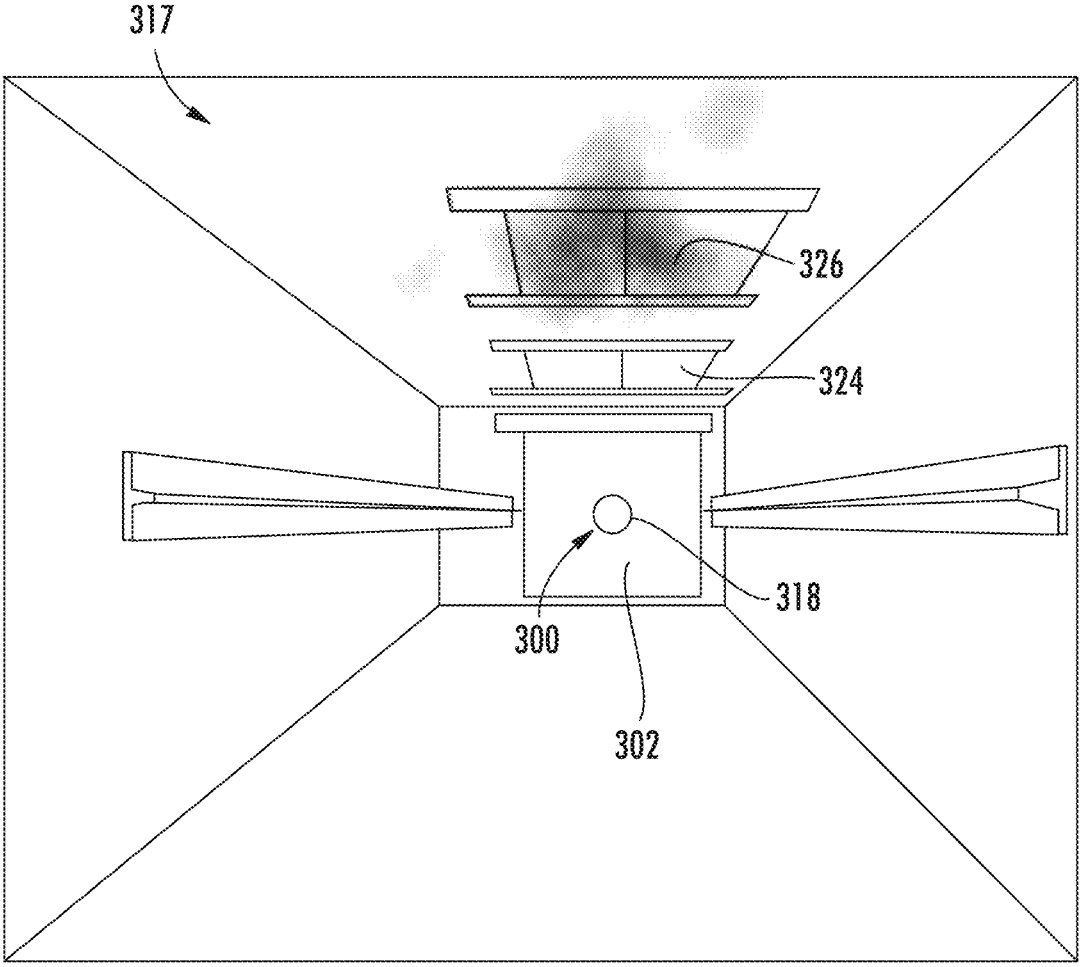
FIG. 3 is a schematic illustration of an elevator shaft and elevator car arranged in accordance with an embodiment of the present disclosure.

For example, turning now to FIG. 3, a schematic illustration of a part of an elevator emergency monitoring system 300 in accordance with an embodiment of the present disclosure is shown. The elevator emergency monitoring system 300 is similar to that shown and described above, and includes an elevator shaft monitoring device 318 mounted on an exterior of an elevator car 302. The elevator shaft monitoring device 318 of this embodiment is angled and arranged to capture live images/video of portions of an elevator shaft 317 located above the elevator car 302.

In this illustration, the elevator shaft monitoring device 318 can observe a first landing door 324 and a second landing door 326 located along the elevator shaft 317 above the elevator car 302. The operation of the elevator emergency monitoring system 300 can be in response to an emergency of the building in which the elevator car 302 is located. Emergency personnel can operate the elevator emergency monitoring system 300 to determine the status of the first and second landing doors 324, 326 (and other landing doors or other aspects of the elevator shaft 317). In this embodiment, the first landing door 324 can be heated due to a fire located proximate the first landing door 324 (e.g., in the hallway of a respective first landing). Further, the second landing door 326 is shown having smoke coming from the respective floor of the second landing door 326. The emergency personnel can use the elevator emergency monitoring system 300 to make live, real-time observations of the conditions within and along the elevator shaft 317 and make decisions based thereon. For example, by knowing where there are heated landing doors and/or smoke, a fireman can readily determine where an emergency is occurring, and can appropriately prepare for such conditions.

Figure 4:
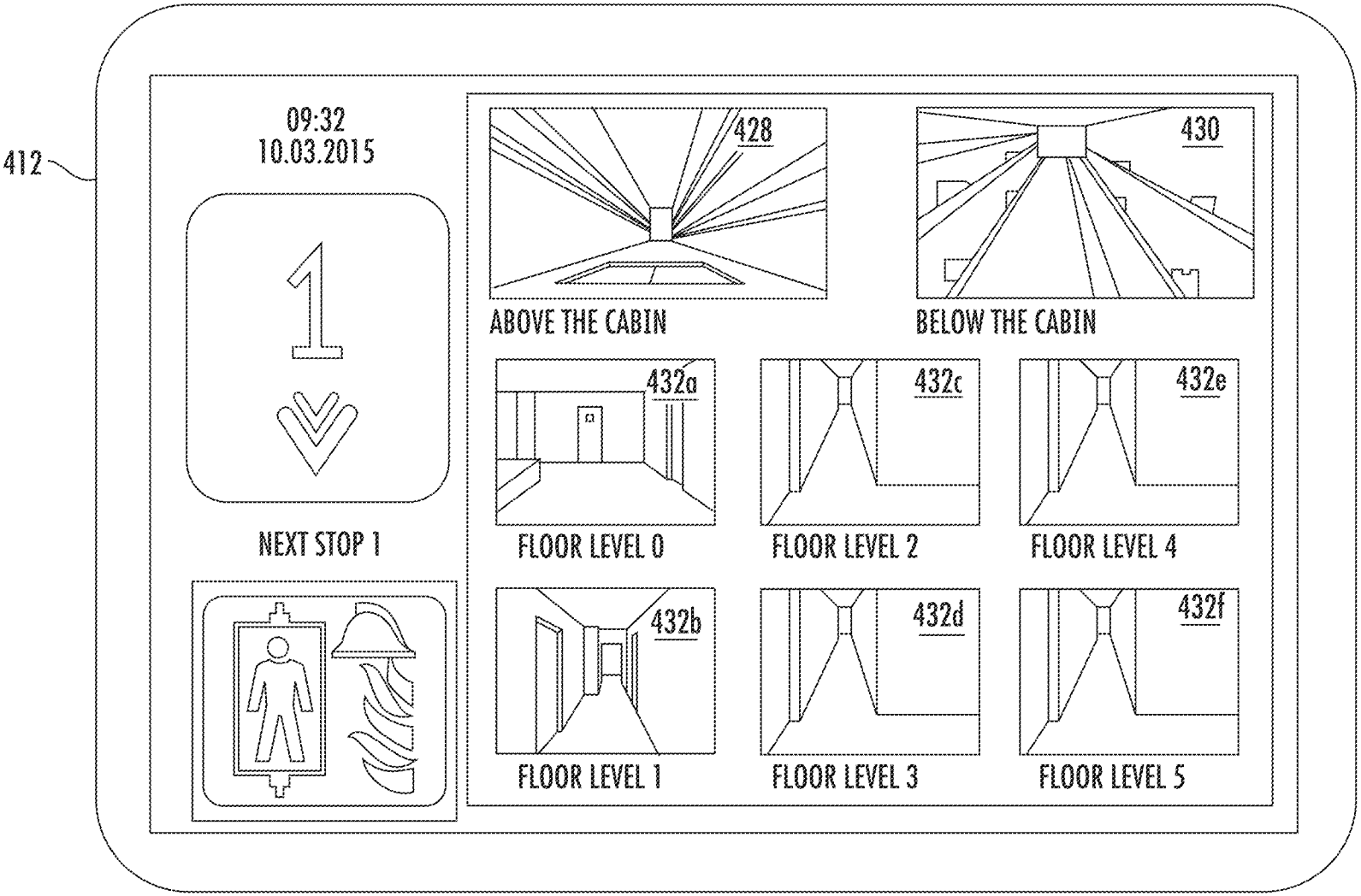
FIG. 4 is a schematic illustration of an elevator car display in accordance with an embodiment of the present disclosure.

Turning now to FIG. 4, a schematic illustration of a display 412 of an elevator emergency monitoring system in accordance with an embodiment of the present disclosure is shown. The display 412 can be a display of a car operating panel of an elevator car or a separate stand-along display, such as shown and described above. The display 412 can provide landing floor, destination floor, weather, programming, etc. during normal elevator operation. However, when an emergency operation mode is activated for the elevator car, the elevator emergency monitoring system can be activated to provide images and information on the display 412, as schematically shown.

In the emergency operation mode of operation, the display 412 will display one or more images, videos, or other live-feed information on the display 412 or a portion thereof. For example, as shown in FIG. 4, a first display image 428, a second display image 430, and a plurality of third display images 432*a-f* are shown. The first display image 428 is a live-feed capture or image of information captured by an elevator shaft monitoring device located on top of an elevator car. Thus, the first display image 428 provides information regarding a portion of an elevator shaft above the elevator car. The second display image 430 is a live-feed capture or image of information captured by an elevator shaft monitoring device located on the bottom of an elevator car. Thus, the second display image 430 provides information regarding a portion of an elevator shaft below the elevator car. The third display images 432*a-f* provide information of landings/hallways of the various landings along the elevator shaft. As such, emergency personnel can readily detect and determine the location(s) and type of emergencies, dangers, and/or conditions associated with different landings and within the elevator shaft itself.

In some embodiments, the display images can be pre-set, variable/adaptive, customizable, and/or selectable. For example, in some embodiments, the display images can capture and display landings of number of nearby/closest landings, to enable the emergency personnel to understand what is occurring at the landings near the location of the elevator car. The selection of the displayed landings can be variable/adaptive based on the present location of the elevator car, and thus which landings are displayed can change as an elevator car travels along an elevator shaft. Alternatively, in some embodiments, the display images can b be of landings surrounding the emergency personnel's destination, such that the emergency personnel can prepare and account for conditions at and/or near the destination landing. Further, in some embodiments, the display images can be configured to display one or more landings in a direction of travel of the elevator car along the elevator shaft. Furthermore, in some embodiments, the operator or emergency personnel can selectively choose specific landings within a building to be displayed or may be able to select a specific mode of operation of display, such as selecting from any of the above described display options, or other display options as will be appreciated by those of skill in the art. The display images described herein can be displayed on one or more displays within an elevator car, thus enabling different display options. For example, with multiple displays, a user can select a particular image on a large display screen, with multiple smaller images of other views being selectable on a secondary or smaller screen.

Figure 5:
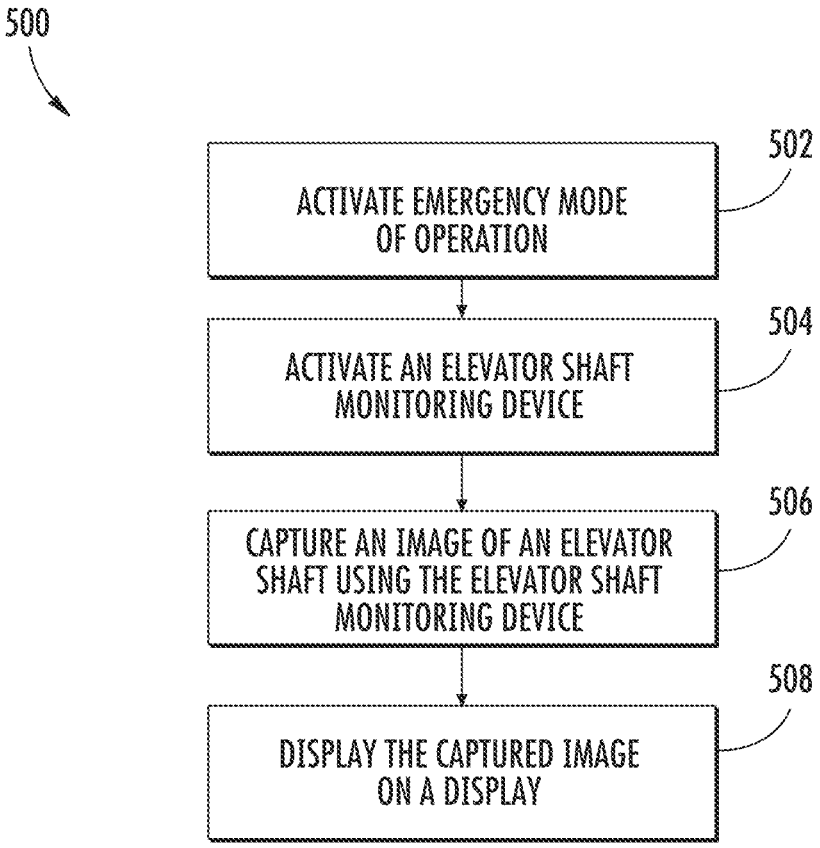
FIG. 5 is a flow process for operating an elevator system in accordance with an embodiment of the present disclosure.

Turning now to FIG. 5, a flow process 500 in accordance with an embodiment of the present disclosure is shown. The flow process 500 is a control and use process for operating an elevator car having an elevator emergency monitoring system installed in accordance with an embodiment of the present disclosure. Accordingly, an elevator car movable within an elevator shaft between a plurality of landings has at least one elevator shaft monitoring device mounted to an exterior of the elevator car. The elevator shaft monitoring device is arranged to capture images of parts of the elevator shaft, and can be, for example, an optical and/or infrared camera. The elevator car includes a display for displaying images or information captured by the elevator shaft monitoring device.

At block 502, an emergency mode of operation is activated. The activation of the emergency mode of operation can be triggered by operation of a key or code entry by emergency or other authorized personnel, as will be appreciated by those of skill in the art. In the emergency mode of operation, emergency personnel can control operation of the elevator car using a car operating panel.

At block 504, when the emergency mode of operation is activated, the elevator shaft monitoring device is activated. One or more elevator shaft monitoring devices can be installed at various locations on the elevator car, with the elevator shaft monitoring devices arranged to capture images or information of the elevator shaft, as the elevator car travels through the elevator shaft. The elevator shaft monitoring devices can be cameras arranged to capture live images or data of the elevator shaft. Further, the elevator shaft monitoring devices can include various wavelength imaging sensors to enable capture and display of different spectra to provide information to persons within the elevator car.

At block 506, the elevator shaft monitoring devices capture live (real time) images and/or video of the elevator shaft.

At block 508, the captured images/video are displayed on one or more displays within the elevator car. At block 508, additional displays can be performed, including displays of images/video captured from cameras located at each of the landings of the elevator system. In such embodiments, not only can emergency personnel determine information from and about the elevator shaft, but they can also determine conditions on the hallway side of elevator landing doors. Further, in some embodiments, the captured images/videos can be transmitted to remote locations, such as locations remote or external to the elevator system and/or external to the building. For example, livestream images and/or data, and/or historical data, can be transmitted to an elevator operator and/or maintenance company/service and/or stored in memory locally or in the cloud. Additionally, images can be communicated to a local (in-building) security system remote locations that have additional computing and/or display capabilities, as will be appreciated by those of skill in the art. Further, the images can be transmitted outside of the building to emergency service remote locations, such as a local fire station or other emergency-based location.

Advantageously, embodiments provided herein are directed to elevator emergency monitoring systems. Such systems are arranged to provide live feed or real time information from and about an elevator shaft, such as smoke, heat signatures, etc. Accordingly, advantageously, emergency personnel can obtain additional and improved information prior to arriving at a landing that has an emergency situation.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator system comprising:

an elevator car located within an elevator shaft having a plurality of landings along the elevator shaft;

a display located within the elevator car; and elevator emergency monitoring system having:

an elevator shaft monitoring device mounted on the elevator car and configured to capture an image of the elevator shaft; and a plurality of landing monitoring devices, wherein at least one landing monitoring device is located at each landing of the elevator shaft and configured to capture an image of the respective landing, wherein the elevator car is operable in an emergency mode of operation such that an image captured by the elevator shaft monitoring device is displayed on the display within the elevator car and an image captured by at least one landing monitoring device located at a respective landing is displayed on the display within the elevator car.

2. The elevator system of claim 1, wherein, during the emergency mode of operation, a first display image is generated on the display.

3. The elevator system of claim 1, wherein the elevator shaft monitoring device is mounted to a top of the elevator car such that a portion of the elevator shaft above the elevator car is captured by the elevator shaft monitoring device.

4. The elevator system of claim 1, wherein the elevator emergency monitoring system includes a second elevator shaft monitoring device, wherein the second elevator shaft monitoring device is mounted to the elevator car such that a portion of the elevator shaft below the elevator car is captured by the elevator shaft monitoring device, and a display image is generated on the display providing an image captured by the second elevator shaft monitoring device.

5. The elevator system of claim 1, wherein the elevator shaft monitoring device comprises at least one of an optical camera, a thermal camera, and an infrared camera.

6. The system of claim 1, wherein, in the emergency mode of operation, multiple images captured by different landing monitoring devices are displayed on the display.

7. A method for operating an elevator system, the method comprising:

activating an emergency mode of operation of an elevator car;

activating an elevator shaft monitoring device mounted on the elevator car;

capturing an image of an elevator shaft using the elevator shaft monitoring device;

activating at least one landing monitoring device arranged at a landing along the elevator shaft, wherein at least one landing monitoring device is located at each landing along the elevator shaft;

capturing at least one image of at least one landing using the at least one landing monitoring device; and displaying the captured image of the elevator shaft and the captured image of the landing on a display within the elevator car.

8. The method of claim 7, wherein, during the emergency mode of operation, the method comprises displaying a first display image on the display.

9. The method of claim 7, wherein the elevator shaft monitoring device is mounted to a top of the elevator car such that a portion of the elevator shaft above the elevator car is captured by the elevator shaft monitoring device.

10. The method of claim 7, wherein the elevator emergency monitoring system includes a second elevator shaft monitoring device, wherein the second elevator shaft monitoring device is mounted to the elevator car such that a portion of the elevator shaft below the elevator car is captured by the second elevator shaft monitoring device.

11. The method of claim 10, further comprising displaying a second display image on the display providing an image captured by the second elevator shaft monitoring device.

12. The method of claim 7, wherein the elevator shaft monitoring device comprises at least one of an optical camera, a thermal camera, and an infrared camera.

13. The method of claim 7, further comprising receiving input from a user and displaying a specific set of captured images based on the received input from the user.

14. The method of claim 7, further comprising transmitting the captured image to a remote location.

15. The method of claim 7, further comprising:

capturing at least one additional image of at least one additional landing using a respective landing monitoring device; and displaying the at least one additional image of the at least one additional landing on the display.

* * * * *